US005195917A

United States Patent [19]

Russell et al.

[11] Patent Number: 5,195,917

[45] Date of Patent: Mar. 23, 1993

[54] TEAR-APART STRESS RELIEF DOLL AND METHOD

[75] Inventors: Mary Russell, Rte. 1, Box 1201, Eastsound, Wash. 98245; Cheryle Karnikis, P.O. Box 178, Orcas, Wash. 98280

[73] Assignees: Mary Russell, Eastsound; Cheryle Karnikis, Orcas, both of Wash.

[21] Appl. No.: 887,409

[22] Filed: May 20, 1992

Related U.S. Application Data

[63] Continuation of Ser. No. 458,895, Dec. 29, 1989, abandoned.

[51] Int. Cl.[5] ..... A63H 3/16; A63H 3/00; A63H 3/02; A63H 3/36

[52] U.S. Cl. ..... 446/97; 446/268; 446/369; 446/385; 446/901

[58] Field of Search ..... 446/97, 99, 100, 4, 446/5, 79, 268, 321, 333, 334, 335, 336, 369, 370, 371, 385, 901

[56] References Cited

U.S. PATENT DOCUMENTS

| | | | |
|---|---|---|---|
| D. 150,028 | 6/1948 | Osborne | D21/180 X |
| D. 152,150 | 12/1948 | Glass | D21/177 |
| D. 163,868 | 7/1951 | Hillery | D21/178 |
| D. 187,027 | 1/1960 | Liebschutz | D21/171 X |
| D. 191,789 | 11/1961 | Rosenberg | D21/177 |
| D. 275,694 | 9/1984 | Abbott et al. | D21/171 |
| D. 287,260 | 12/1986 | Nixon | D21/171 X |
| D. 290,863 | 7/1987 | Dockery | D21/177 |
| D. 303,413 | 9/1989 | Russell et al. | D21/177 |
| 1,210,892 | 1/1917 | Borchmann | D21/177 X |
| 1,277,702 | 9/1918 | Des Combes | 446/4 |
| 1,621,057 | 3/1927 | Brower | 446/336 |
| 1,932,317 | 10/1933 | Ledbeer | 446/335 |
| 3,235,259 | 2/1966 | Glass et al. | 446/334 X |
| 3,375,604 | 4/1968 | Alonso | 446/97 X |
| 3,651,598 | 3/1972 | Lang | 446/268 |
| 3,883,984 | 5/1975 | Champeaux | 446/97 X |
| 4,085,540 | 4/1978 | Jerstrom et al. | 446/354 X |
| 4,208,832 | 6/1980 | Corriveau | 446/100 |
| 4,579,537 | 5/1984 | Leahy | 446/100 |
| 4,738,647 | 4/1988 | Renger et al. | 446/268 X |
| 4,869,701 | 9/1989 | Kawai et al. | 446/99 X |
| 4,883,441 | 11/1989 | Byer | 446/99 |
| 5,090,935 | 2/1992 | Monson | 446/901 X |

FOREIGN PATENT DOCUMENTS

| | | | |
|---|---|---|---|
| 0356626 | 3/1990 | European Pat. Off. | 446/901 |
| 2250506 | 4/1974 | Fed. Rep. of Germany | 446/99 |
| 566160 | 9/1975 | Switzerland | 446/99 |
| 2013508 | 8/1979 | United Kingdom . | |

*Primary Examiner*—D. Neal Muir
*Attorney, Agent, or Firm*—Carter & Schnedler

[57] ABSTRACT

A method for relieving tension, and a stress-relief doll figure for practicing the method. A doll is provided representing a source of stress, such as a television sports referee. The doll has a torso, legs, arms and a head each removably attached by means of Velcro such that the limbs and head can be selectively torn off in repsonse to an action of the source of stress, such as a "bad call", and subsequently replaced. A method and means for relieving tension in a satisfying manner are thus provided.

4 Claims, 1 Drawing Sheet

TEAR-APART STRESS RELIEF DOLL AND METHOD

CROSS-REFERENCE TO RELATED APPLICATION

This is a continuation of application Ser. No. 07/458,895, filed Dec. 29, 1989 now abandoned.

BACKGROUND OF THE INVENTION

The present invention relates to a method for relieving stress-inducing tension, and to a stress-relief doll figure for practicing the method.

A source of stress for television sports fans is "bad calls" or perceived "bad calls" by sports referees or umpires. There are other situations where a person of a particular category can by certain actions constitute a source of stress, even extending to an individual himself in the case of games such as golf.

SUMMARY OF THE INVENTION

Accordingly, it is an object of the invention to provide methods and devices for relieving tension induced by a source of stress in the form of a person, especially a person of a particular category.

In accordance with one aspect, a method for relieving tension includes providing a doll representing the source of tension-inducing stress. The doll has a torso portion, leg elements, arm elements and a head element. At least some of the elements are removably attached to the torso portion, for example by means of hook-and-loop fastening material sold under the trademark "velcro". The removably-attached elements ca selectively be torn off the torso portion in response to an action of the source of stress, thereby aiding in relieving tension, and subsequently replaced.

In one particular embodiment, the method includes providing a doll in the form of a sports referee such that the removably-attached elements can selectively be torn off in the event of a bad call, or a perceived bad call.

In accordance with another aspect of the invention, there is provided a tear-apart tension-relieving doll including a torso portion, a pair of leg elements, a pair of arm elements and a head element. The various elements, when attached to the torso portion, form a figure representing a source of tension-inducing stress. At least some of the elements are removably attached to the torso portion such that the removably-attached elements can selectively be torn off the torso portion in response to an action of the source of stress, and subsequently replaced. Preferably, the removably-attached elements are attached to the torso portion by means of the hook-and-loop fastening material sold under the trademark "velcro".

In a particular embodiment, the tear-apart stress-relief doll in accordance with the invention comprises a sports referee figure such that the removably-attached elements can selectively be torn off in the event of a bad call.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DETAILED DESCRIPTION

Figure 1:
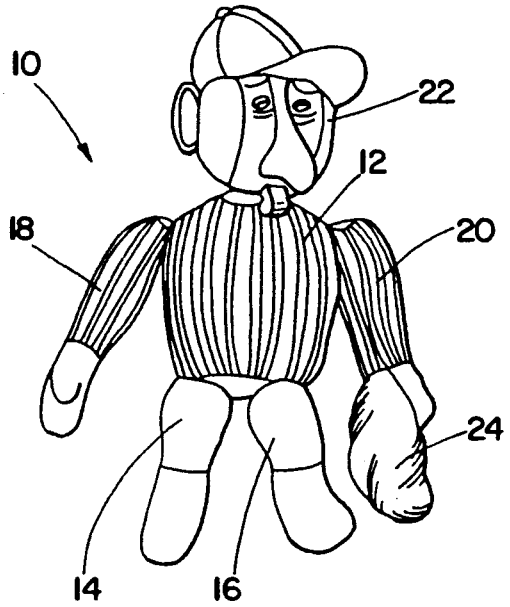
FIG. 1 depicts a stress-relief doll in accordance with the invention with limbs and head attached to the torso portion.

Referring first to FIG. 1, depicted is a tear-apart tension-relieving doll FIG. 10 in the form of a figure representing a source of stress, particularly a sports referee. Preferably, the doll 10 is of conventional stuffed configuration having a fabric outer surface and suitable filling material such that the likelihood of damage is minimized when component parts of the doll 10 are torn off and thrown about a room.

More particularly, the doll FIG. 10 includes a torso portion 12, a pair of leg elements 14 and 16, a pair of arm elements 18 and 20, and a head element 22. The hand of the left arm 20 holds a flag 24 such as is thrown by a football referee to indicate a penalty. At least some of these elements 14, 16, 18, 20 and 22, preferably all five, are removably attached to the torso portion 12 such that the removably-attached elements 14, 16, 18, 20 and 22 can selectively be torn off the torso portion 12 in response to an action of the source of stress represented by the doll 10, and subsequently replaced.

Figure 4:
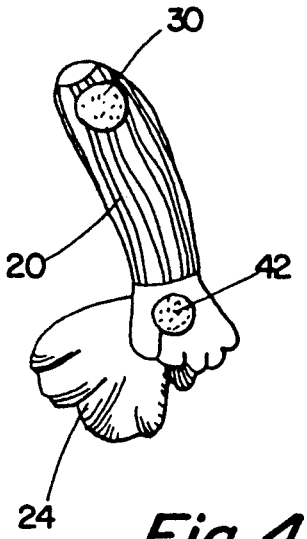
FIG. 4 is a similar enlarged view of an arm element likewise depicting one manner in which hook-and-loop fastening material may be applied.
Figure 3:
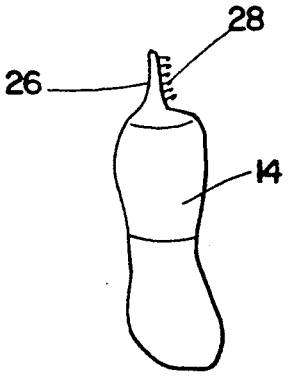
FIG. 3 is an enlarged view of a leg element depicting one manner in which hook-and-loop fastening material may be applied.
Figure 2:
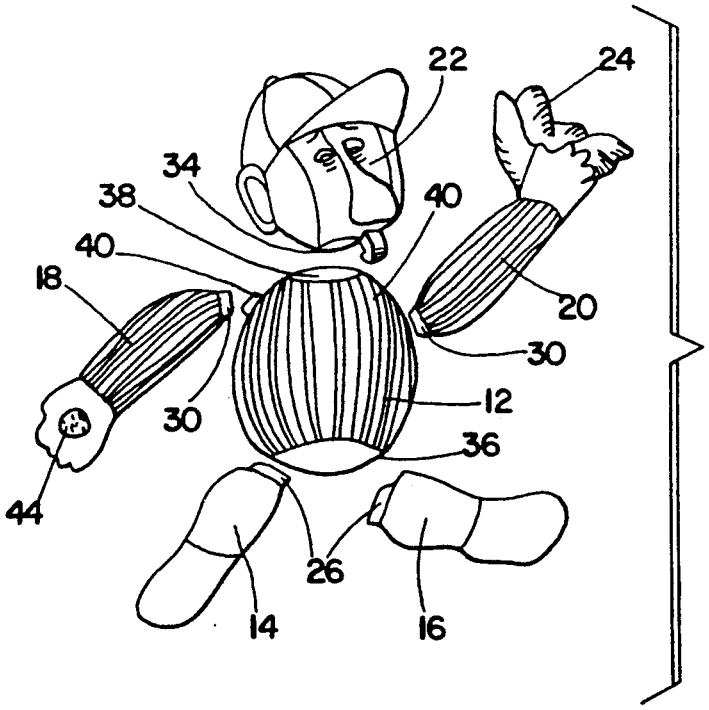
FIG. 2 shows the doll figure of FIG. 1 with all four limbs and the head torn off the torso portion.

As may be seen in FIGS. 2, 3 and 4, the removably-attached elements 14, 16, 18, 20 and 22 are preferably attached by means of hook-and-loop fastening material, such as "velcro". As is known, hook-and-loop fastening material comprises a two-part system, one part being in the form of stock sheet material from which a multiplicity of tiny plastic hooks project (hook material), and the other part is in the form of stock sheet material having a multiplicity of tiny plastic loops (loop material).

In one construction, detailed in FIG. 3, the leg elements 14 and 16 include at their upper ends a fold 26 of material to which a strip 28 of the hook material is attached such as by sewing. Similarly, as detailed in FIG. 4, the arm elements 18 and 20 near their upper ends each have a small circle 30 of hook material similarly affixed by sewing. Finally, as may be seen in FIG. 2, on the underside of the head 22 is a strip 34 of hook material.

Corresponding sections or areas of loop material are incorporated on the torso 12. Specifically, lower and upper portions 36 and 38 of the torso 12 have incorporated as the outer surface loop material comprising loop elements for respectively engaging the hook material 28 of the leg elements 14 and 16 and the hook material 34 of the head 22. In addition, circles 40 of loop material are sewn to the sides of the torso 12 in a position appropriate for arm element 18 and 20 attachment.

Also visible in FIG. 4 is a circle 42 of hook or loop material on the palm of the hand for removably attaching to a corresponding circle 44 on the other hand. Thus, the two hands may be joined together so that the doll FIG. 10 can hold an object such as a television remote control between games.

As noted above, the tear-apart stress-relief doll 10 in the particular form of a sports referee is intended to be employed by a television sports fan to relieve tension induced by stress caused by the action of referees or umpires during th course of a game shown on television.

In general, during games, the doll FIG. 10 can literally be torn limb-from-limb when idiotic or bad calls are made. While appropriate responses to bad calls can be developed by each individual television sports fan for maximum tension-relieving satisfaction, the following are examples.

In the case of football, for a "roughing the kicker" penalty, the appropriate leg element 14 or 16 can be torn off, and the remainder of the doll FIG. 10 can be kicked towards a corner of the room. For a "holding penalty", both arms can be violently torn off, and thrown at the referee on the television set while he attempts to explain the call. For "pass interference", the head 22 can be jerked off, and applied to another portion of the doll's anatomy to which loop material is attached.

In the case of basketball, for a call of "walking", both leg elements 14 and 16 can be ripped off the torso 12, and thrown at a fellow viewer. For a call of "goal-tending", if called against a right-handed shooter, the right arm element 18 can be torn off, and dunked into the nearest trash can. For a left-handed shooter, the opposite arm element. For a "technical foul", the response can be the same as for a pass-interference penalty in football.

While shown as a sports referee figure, the tear-apart stress-relief doll 10 of the invention can take a variety of other forms representing figures whose actions can provide a source of stress. Examples are a lawyer, a boss or a person, depicted as an animal pig figure, who "hogs" a television remote control. Additionally, the doll can represent a person himself, such as in the case of a golfer, who may tear off a limb of the golfer doll in the event of a bad shot.

It will be apparent therefore that the present invention provides a method and means for relieving tension in a satisfying manner.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A method for relieving tension, comprising:

providing a stuffed doll simulating a sports referee with indicia simulating a referee uniform, the doll representing an actual sports referee whose actions can constitute a source of tension-inducing stress, the doll having a torso portion; and leg elements, arm elements, said arm elements mounting a releasable attachment means and terminating in a simulated hand and said leg elements comprising a fabric casing, the fabric extended into an integral flap which mounts a releasable attachment means, a flag attached to one of said hands and a head element with releasable attachments, at least some of the elements being removably attached to the torso portion by said attachment means, said elements selectively torn off the torso portion in response to an action of the actual sports referee, such as in the event of a bad call, and the removably-attached elements subsequently replaced after user tension has been relieved.

2. A method in accordance with claim 1, which comprises providing a doll wherein the removably-attached elements releasable attachment means comprise hook-and-loop fastening material.

3. A tear-apart tension-relieving stuffed doll comprising:

a torso portion;

a pair of leg elements, a pair of arm elements, said arm elements mounting a releasable attachment means and terminating in a simulated hand and said leg elements comprising a fabric casing, the fabric extended into an integral flap which mounts a releasable attachment means, a flag attached to one of said hands and a head element with releasably attachment means which, when attached to said torso portion, form a sports referee figure with indicia simulating a referee uniform representing an actual sports referee whose actions can constitute a source of tension-inducing stress; and at least some of said elements being removably attached to said torso portion by said attachment means such that said removably-attached elements can selectively be torn off said torso portion in response to an action of the actual sports referee, such as in the event of a bad call, and said removably-attached elements can be subsequently replaced.

4. A tear-apart tension-relieving doll in accordance with claim 3, said releasable attachment means comprise hook-and-loop fastening material for removably attaching said removably-attached elements to said torso portion.

* * * * *